United States Patent [19]

Miller et al.

[11] Patent Number: 4,757,858

[45] Date of Patent: Jul. 19, 1988

[54] VEHICLE FAN AND RADIATOR ASSEMBLY

[75] Inventors: Wayne R. Miller; David D. Latham, both of Dubuque, Iowa

[73] Assignee: Deere & Company, Moline, Ill.

[21] Appl. No.: 401,780

[22] Filed: Jul. 26, 1982

[51] Int. Cl.[4] ..... F24B 1/06; F01P 7/10

[52] U.S. Cl. ..... 165/41; 165/124; 123/41.49; 180/68.4

[58] Field of Search ..... 165/41, 51, 144, 122, 165/124; 180/68.4, 5.6; 123/41.49

[56] References Cited

U.S. PATENT DOCUMENTS

| | | | |
|---|---|---|---|
| 1,650,259 | 11/1927 | Broberg et al. | 165/124 |
| 2,317,849 | 4/1943 | Essl | 123/41.49 X |
| 2,336,840 | 12/1943 | Brehob | 123/41.49 X |
| 2,897,802 | 8/1959 | Haas | 123/41.49 |
| 3,203,499 | 8/1965 | Bentz et al. | 165/41 |
| 3,366,167 | 1/1968 | Dabber | 165/122 |
| 3,401,605 | 9/1968 | Born | 91/419 |
| 3,664,129 | 5/1972 | Schwab | 60/53 R |
| 3,731,660 | 5/1973 | Leffert | 165/51 |

*Primary Examiner*—Allen M. Ostrager

[57] ABSTRACT

An industrial loader includes a fan and radiator assembly mounted above the engine thereof. The assembly comprises a housing mounted on the loader main frame. A pair of radiator cores are located in opposite sides of the housing. A pair of fore-and-aft aligned, hydraulically driven fans are mounted in the housing and operate to draw cooling air in through the cores and discharge it vertically through the top of the housing.

6 Claims, 3 Drawing Sheets

VEHICLE FAN AND RADIATOR ASSEMBLY

BACKGROUND OF THE INVENTION

The present invention relates to cooling systems for internal combustion engines of vehicles and more specifically relates to fan and radiator assemblies of such systems as are embodied in industrial tractors.

Typically, an industrial tractor is equipped with a fan and radiator assembly mounted at one end of the tractor, with the fan being coupled to an exposed end of the engine crankshaft so as to be continuously driven whenever the engine is running. This location of the fan and radiator assembly has the disadvantage that when the tractor is working in dusty environments, the fan draws air from areas containing a relatively high concentration of particles and these particles become entrained in the stream of air forced through the radiator by the fan and thus "sandblast" and cause wear to the relatively soft core of the radiator.

In the case of an articulated, four-wheel drive tractor, the overall length of the tractor is kept reasonable only by mounting the engine above the differential housing of the drive to one of the pairs of drive wheels, however, such positioning of the engine raises the center of gravity of and consequently adversely affects the stability of the tractor. Also, the torque converter is then positioned such as to be difficult to service and a relatively high drop box is required to connect the engine output shaft to the differential housing.

It is common practice to provide an industrial tractor of the aforedescribed type with shrouding and baffling arranged to intercept and dampen noise generated by the engine and fan. Such shrouding and baffling, and the engine and any other components which may be in the airstream producted by the fan impedes the flow of air through and thus lowers the efficiency of the fan. Along with this lower efficiency comes higher noise so that a compromise between quietness and cooling exists.

SUMMARY OF THE INVENTION

According to the present invention there is provided an improved radiator and fan assembly which may be advantageously applied to most types of industrial tractors, but with the most advantages resulting from use with articulated, four-wheel drive tractors.

The invention is herein disclosed in conjunction with an articulated, four-wheel drive industrial loader and comprises a pair of fore-and-aft aligned, hydraulically driven fans located in a housing mounted above the tractor engine, with the latter being positioned rearwardly and partially below the level of a differential housing associated with the rear drive wheels of the loader. Mounted in opposite sides of the fan housing is a pair of radiators and the fans operate to draw cooling air therethrough and exhaust the air vertically. The fans are driven by a hydraulic motor, the speed of which is modulated in response to coolant temperature.

A broad object of the invention is to provide a vehicle fan and radiator assembly which overcomes the above-noted shortcomings of conventional fan and radiator assemblies.

Specifically, it is an object of the invention to provide a fan and radiator assembly which is mounted above the vehicle engine so that there is a minimum of impedance to air flow and to arrange the fans for exhausting the air vertically so as to enhance fan efficiency and at the same time reduce bystander noise levels.

A further object of the invention is to provide a fan and radiator assembly which is mounted above the vehicle engine such that the assembly is easily accessible for service, and application of the assembly to an articulated, four-wheel drive vehicle makes it possible to locate the engine at a level below a differential housing associated with one set of drive wheels so as to improve vehicle stability and torque converter accessibility for service.

A further object of the invention is to provide a fan and radiator assembly located for drawing air in from a relatively high level thereby ensuring a relatively clean supply of air and hence, a reduction in "sandblasting" of the radiator.

Yet another object of the invention is to provide a fan and radiator assembly comprising a pair of transversely spaced, fore-and-aft extending radiator cores located in opposite sides of a housing placed over a vehicle engine and containing a pair of fans selectively hydraulically driven in response to coolant condition whereby adequate cooling is efficiently accomplished in a relatively small space.

These and other objects will become apparent from reading the ensuing description together with the appended drawings.

DESCRIPTION OF THE PREFERRED EMBODIMENT

Figures 1, 2:
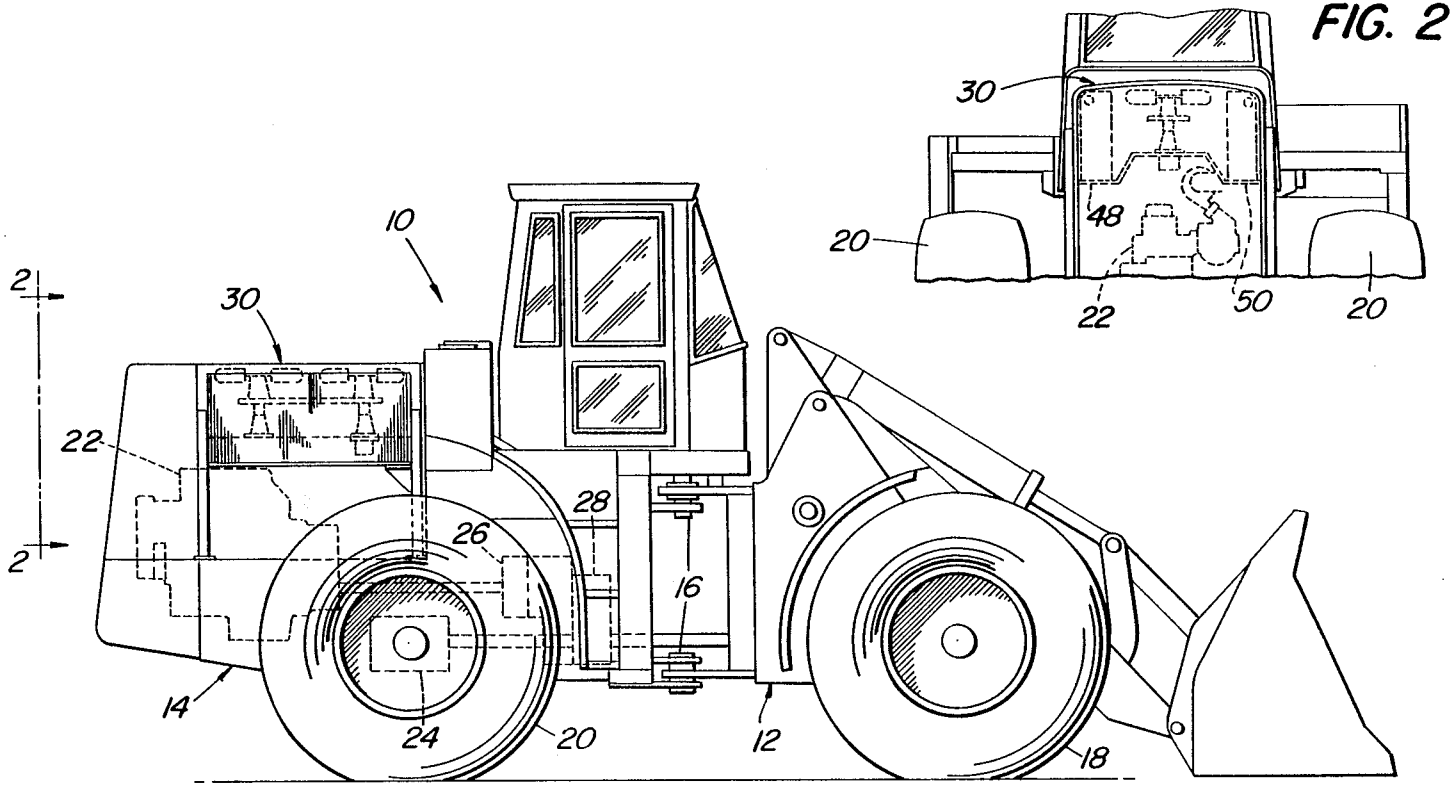
FIG. 1 is a right side elevational view of an articulated, four-wheel drive industrial loader embodying a fan and radiator assembly constructed in accordance with the principles of the present invention.
FIG. 2 is a rear elevational view of the loader taken along line 2—2 of FIG. 1.
Figure 3:
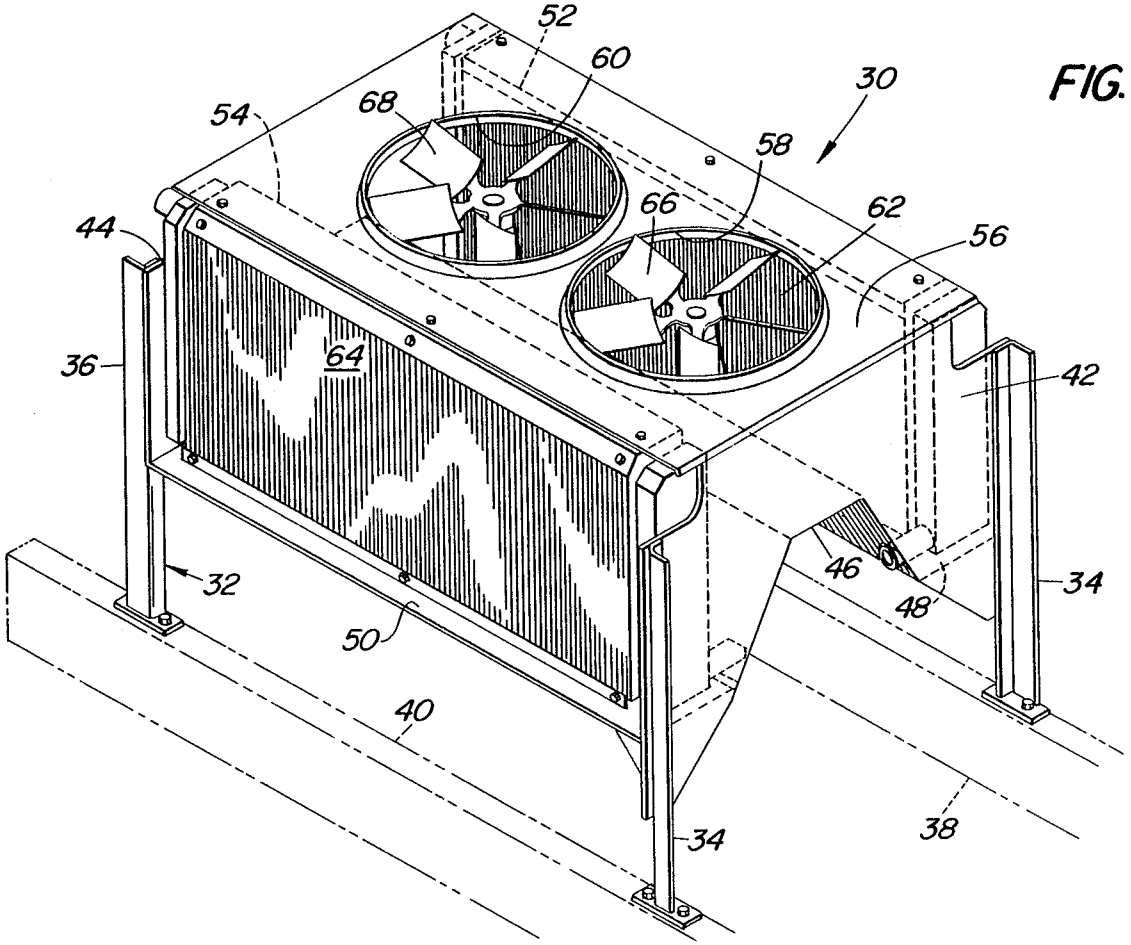
FIG. 3 is a perspective of the fan and radiator assembly and its connection with the tractor frame.

Referring now to FIG. 1, therein is shown an industrial loader indicated in its entirety by the reference numeral 10. The loader 10 includes front and rear frame sections 12 and 14, respectively, pivotally interconnected by a vertical pivot assembly 16 and respectively supported on front and rear pairs of drive wheels 18 and 20.

An internal combustion engine 22 is supported by a rear portion of the rear frame section 14 at a location rearwardly of and partially the top of a differential housing 24 of a drive connected to the rear wheels 20. This location of the engine 22 would not be possible in a conventional loader since a fan and radiator assembly would be located in the area occupied by the rearward end of the engine. Thus, the engine 22 would have to be moved forwardly and raised above the differential housing in order to position it as it would have to be in a conventional loader. A transmission includes a torque converter section 26 located in an accessible area forwardly of the housing 24 and includes a drop box section 28 having an output shaft coupled to the gearing in the differential housing 24. Thus, it will be appreciated that the drop box section is of a lesser height than would be the case if the engine were mounted above the differential housing.

Located above the engine 22 is a fan and radiator assembly 30 comprising a support structure 32 including fore-and-aft spaced, front and rear pairs of vertical support posts 34 and 36, respectively. The loader rear frame section 14 includes a pair of transversely spaced fore-and-aft extending channel-shaped frame members 38 and 40 extending along opposite sides of the engine 22 and one of each of the pairs of posts 34 and 36 has its lower end releasably secured to an upper flange of the frame member 38 while the other of each of the pairs of posts has its lower end releasably secured to the frame member 40. The front pair of posts 34 are interconnected by a vertical front end wall 42 while the rear pair of posts 36 are similarly interconnected by a vertical rear end wall 44. An inverted generally V-shaped bottom wall 46, which is substantially rectangular in plan view, has its opposite ends joined to the end walls 42 and 44 and has respective corner portions joined to the pairs of posts 34 and 36. Opposite, generally rectangular edge portions 48 and 50 of the bottom wall 46 extend between the end walls 42 and 44. A first rectangular radiator support frame 52 has a lower frame member engaged with and releasably secured to the rectangular edge portion 48 while a second rectangular radiator support frame 54 has a lower frame member similarly engaged with and releasably secured to the rectangular edge portion 48. Opposite upright end members of each of the first and second frames 52 and 54 are respectively releasably secured to the end walls 42 and 44. A top wall 56 extends between and is releasably secured to respective upper frame members of the first and second frames 52 and 54. A fore-and-aft spaced pair of circular air outlet openings 58 and 60 are provided in the top wall 56.

Respectively mounted in the radiator support frames 52 and 54 are rectangular radiator cores 62 and 64. Provided within the housing or chamber formed by the end walls 42 and 44, the bottom wall 46, the top wall 56 and the radiator cores 62 and 64 are front and rear fan assemblies 66 and 68 which are located vertically below the openings 58 and 60 and operate to draw air in through the radiator cores 62 and 64 and exhaust the same vertically through the openings 58 and 60, the air thus having an unobstructed path so that the pressure drop through the fan assemblies is relatively low with the result that the efficiency is high. Specifically, the fan assembly 66 comprises an upright, hollow shaft support 70 having an annular base 72 releasably secured to the bottom wall 46 in surrounding relationship to a circular opening 74 provided in the latter. A hydraulic drive motor 76 has an upper end received in the opening 74 and has an annular mounting flange 78 engaged with a lower surface of the bottom wall and held in place by a set of fasteners which also serve to hold the shaft support 70 in place. The motor 76 has a vertical output shaft 80 which is fixed to the lower end of a drive shaft 82 having an intermediate section supported in an upper end portion of the support 70 by a bearing 84. A fan drive pulley 86 is secured to an upper end portion of the shaft 82 and a first fan blade 88 is secured to an upper surface of the pulley 86. The fan assembly 68 also includes an upright hollow shaft support 90 having a base 92 releasably secured to the bottom wall 46. A vertical drive shaft (not shown) is supported for rotation in an upper portion of the support 90 by means of a pair of spaced bearings. A pulley 94 is fixed to an upper portion of the shaft, and a drive belt 96 is received about the pulleys 86 and 94 and serves to transfer the rotation of the hydraulic motor output shaft 80 to the pulley 94. A second fan blade 98 is fixed to an upper surface of the pulley 94. The drive belt 96 is maintained in proper tension by an idler pulley 100 which is mounted to an idler arm 102 which is pivotally mounted to the support structure 32 for swinging in the plane of the belt, and an adjustable tension coil spring 104 is mounted between the arm and support structure 32 for maintaining the pulley 100 in biased engagement with the belt.

Figure 4:
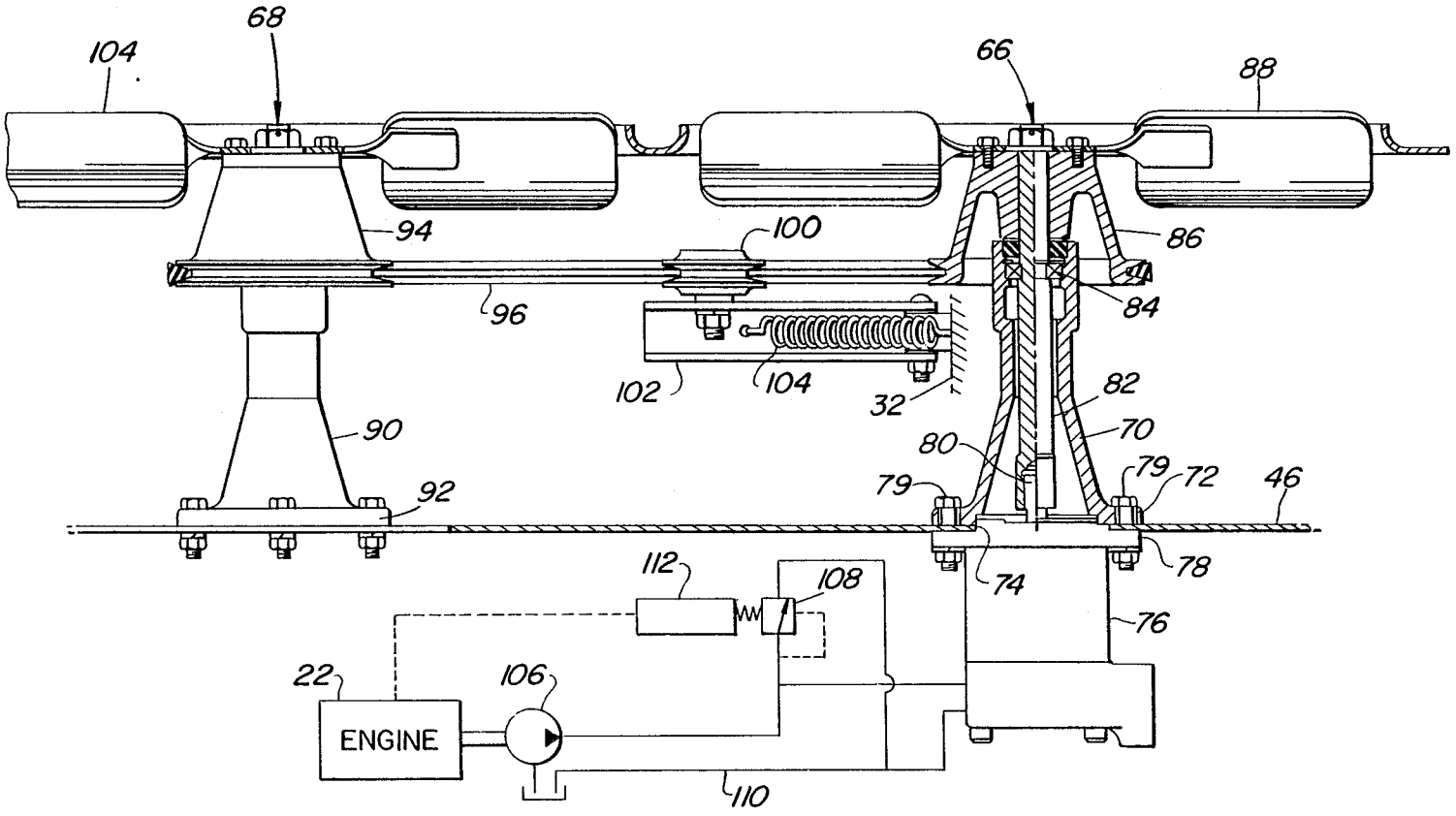
FIG. 4 is a side elevational view of the fan assembly showing the mountings of and drive for the fans.

The hydraulic drive motor 76 is preferably controlled such that its speed is varied in accordance with coolant temperature. Such a control is depicted schematically in FIG. 4 and includes a pump 106 driven by the engine 22 and having its output coupled to the hydraulic motor 76. A relief valve 108 is coupled between the output of the pump 106 and a return line 110 extending from the motor. A coolant temperature responsive element 112 is connected in communication with coolant in the engine and operates in response to the temperature to modulate the relief of fluid through the valve 108 and thus modulates the speed of operation of the motor 76. It will be appreciated then that the speed of the fan assemblies 66 and 68 is kept at a minimum and therefore that the noise generated by the fan assemblies is minimized.

It will be appreciated that the fan and radiator assembly 30 may be easily removed for servicing or for providing access to the engine 22 by disconnecting the legs 36 and 34 from the frame 14, disconnecting coolant conduits from the radiator cores 62 and 64 and by disconnecting the fluid supply and return conduits from the hydraulic motor 76 and then by attaching a hoist to appropriately positioned lift eyes (not shown) connected to the assembly frame 32.

The operation of the invention is thought to be clearly evident from the foregoing description and for the sake of brevity is not reiterated.

What is claimed is:

1. In a vehicle including a main frame comprising a pair of fore-and-aft extending, transversely spaced frame members and an internal combustion engine positioned between and supported by the pair of frame members, a cooling system for the internal combustion engine, comprising: a housing releasably secured to the pair of frame members exclusive of and in overlying relationship to the engine; said housing including top, bottom and opposite end walls cooperating to define generally rectangular openings in opposite sides thereof; outlet opening means located in said top wall; engine cooling coil means located in said rectangular openings and mounted to said housing; and fan means located in an mounted to the housing for drawing air in through the cooling coil means and exhausting it through the outlet opening means.

2. The vehicle as defined in claim 1 wherein said fan means comprises first and second, fore-and-aft aligned fans; said fans each including a blade and a drive shaft coupled to the blade; a hydraulic motor coupled to a drive shaft of the first fan and drive transfer means coupling the drive shaft of the first fan to the drive shaft of the second fan and coolant temperature control means for modulating the speed of the motor in accordance with coolant temperature.

3. The vehicle defined in claim 1 wherein said housing is in the form of a rectangular box having four upright corners; four support legs having upper portions respectively forming said upright corners and having lower ends secured to said transversely spaced frame members.

4. The vehicle defined in claim 2 wherein said drive transfer means comprises a pulley mounted on each of said shafts and a belt received about the pulleys; an idler pulley arm being mounted for pivotal movement toward and away from the belt; an idler pulley mounted on the arm and engaged with the belt; and a biasing means acting on the arm to maintain the idler pulley in engagement with the belt.

5. An engine cooling fan and radiator assembly adapted for mounting above an internal combustion engine to be cooled comprising: a bottom support wall formed for being mounted in close spaced relationship to the top of an engine; a pair of end walls respectively joined to and projecting upwardly from opposite ends of the bottom wall; said bottom wall having generally horizontal rectangular mounting portions along opposite sides thereof; a pair of generally rectangular, upright frames defining respective rectangular openings and having lower frame members respectively engaged with and releasably secured to said generally horizontal rectangular mounting portions; a top wall extending between and being releasably secured to respective upper frame members of the frames; a pair of circular air outlet openings located in said top wall; a pair of radiators respectively mounted to said pair of frames and located within said rectangular openings; and a pair of fans mounted to the bottom wall and having respective blades located beneath said outlet openings.

6. The cooling fan and radiator assembly defined in claim 5 and further including four support posts respectively joined to opposite edges of and extending below said end walls.

* * * * *